US006311584B1

(12) United States Patent
Chu

(10) Patent No.: US 6,311,584 B1
(45) Date of Patent: Nov. 6, 2001

(54) RATCHET WRENCH HAVING AN ADDITIONAL DRIVING DEVICE

(76) Inventor: Te Chen Chu, No. 369, Si Hu Road, Da Li City, Taichung Hsien (TW), 412

( * ) Notice: Subject to any disclaimer, the term of this patent is extended or adjusted under 35 U.S.C. 154(b) by 0 days.

(21) Appl. No.: 09/590,179

(22) Filed: Jun. 9, 2000

(51) Int. Cl.[7] ..... B25B 17/00

(52) U.S. Cl. ..... 81/57.29; 81/58.1; 81/62; 81/59.1

(58) Field of Search ..... 81/57.29, 58, 58.1, 81/60, 61, 62, 63.1, 59.1

(56) References Cited

U.S. PATENT DOCUMENTS 2,703,030 * 3/1955 Marvin ..... 81/58.1
4,532,832 * 8/1985 Christensen ..... 81/57.29
4,545,267 * 10/1985 Shumway ..... 81/57.29
5,058,463 10/1991 Wannop ..... 81/57.29
6,070,499 * 6/2000 Wisbey ..... 81/57.29

* cited by examiner

*Primary Examiner*—Joseph J. Hail, III
*Assistant Examiner*—Joni B. Danganan
(74) *Attorney, Agent, or Firm*—Charles E. Baxley

(57) ABSTRACT

A ratchet wrench includes a handle having an internal gear formed in a head. One or more ring gears are rotatably received in the head and engaged with a bevel gear which is received in the handle for rotating the ring gears. A seat is rotatably received in the head and has a driving stem and includes two rotatable pawls each having two end teeth for selectively engaging with the internal gear and for selectively driving the driving stem. One or more rods are engaged between the ring gears and the seat to drive the seat and the driving stem with the ring gears.

10 Claims, 8 Drawing Sheets

RATCHET WRENCH HAVING AN ADDITIONAL DRIVING DEVICE

BACKGROUND OF THE INVENTION

1. Field of the Invention

The present invention relates to a ratchet wrench, and more particularly to a ratchet wrench having an additional driving device.

2. Description of the Prior Art

Various kinds of ratchet wrenches have been developed for effectively driving the fasteners. U.S. Pat. No. 5,058,463 to Wannop discloses a typical ratchet wrench having a driving device rotatably received in a driving head, and a device provided for rotating the driving device with bevel gears. However, the bevel gears are subjected with large torques or large forces whenever the ratchet wrench is used such that the bevel gears will be easily damaged.

The present invention has arisen to mitigate and/or obviate the afore-described disadvantages of the conventional ratchet wrenches.

SUMMARY OF THE INVENTION

The primary objective of the present invention is to provide a ratchet wrench having an additional driving device for driving the driving stem.

In accordance with one aspect of the invention, there is provided a ratchet wrench comprising a handle including a first end having a head formed thereon, the head including an internal gear formed therein, the handle including a bore formed therein and communicating with the internal gear, at least one ring gear rotatably received in the head, a bevel gear rotatably received in the bore of the handle and engaged with the ring gear for rotating the ring gear in either direction, a seat rotatably received in the head and including a driving stem extended therefrom, a pair of pawls rotatably secured to the seat and each including two ends for selectively engaging with the internal gear, at least one rod engaged between the ring gear and the seat to selectively drive the seat with the ring gear, and means for rotating the bevel gear to rotate the ring gear with the rod.

The seat includes at least one surface formed thereon for defining a channel between the seat and the ring gear and for defining two narrow ends for the channel. A device is provided for moving the rod to either of the narrow ends of the channel and includes at least one actuator rotatably secured on the seat and having a first end for receiving the rod, and means for rotating the actuator to move the rod to either of the narrow ends of the channel.

A block is secured to the seat and includes at least one surface formed thereon for defining a channel between the block and the ring gear and for defining two narrow ends for the channel. The block includes an aperture formed therein, a knob includes an extension rotatably received in the aperture of the block and includes a device for selectively actuating the ends of the pawls to engage with the internal gear.

The actuating device includes a pair of spring-biased projections received in the extension of the knob and engaged with the pawls. The knob includes at least one actuator rotatably secured on the seat and having a first end for receiving the rod, and the extension includes at least one recess for rotatably receiving a second end of the actuator.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
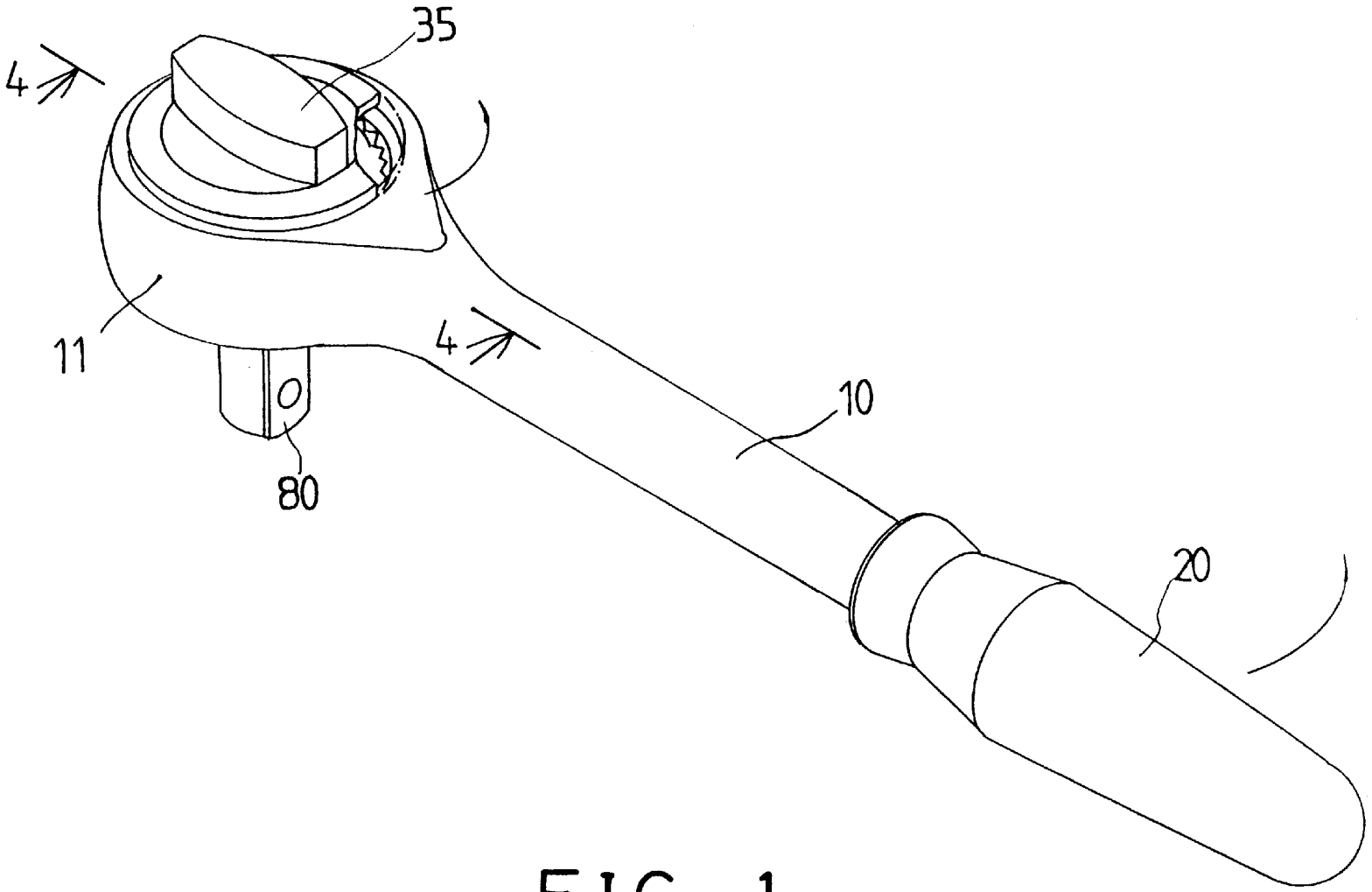
FIG. 1 is a perspective view of a ratchet wrench in accordance with the present invention.
Figure 2:
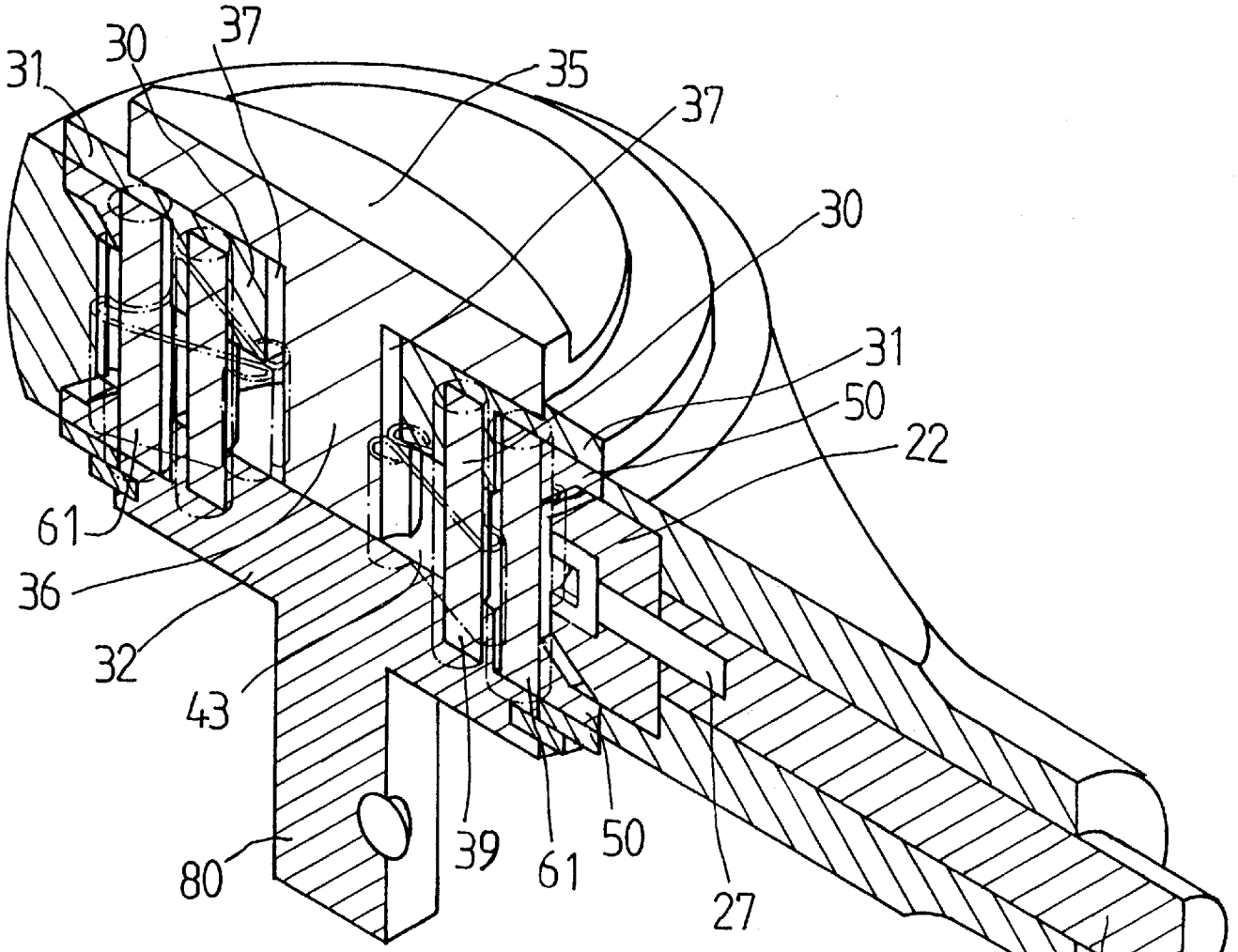
FIG. 2 is a partial perspective view of the ratchet wrench, in which one half of the ratchet wrench is cut off for showing the inner structure of the ratchet wrench.
Figure 3:
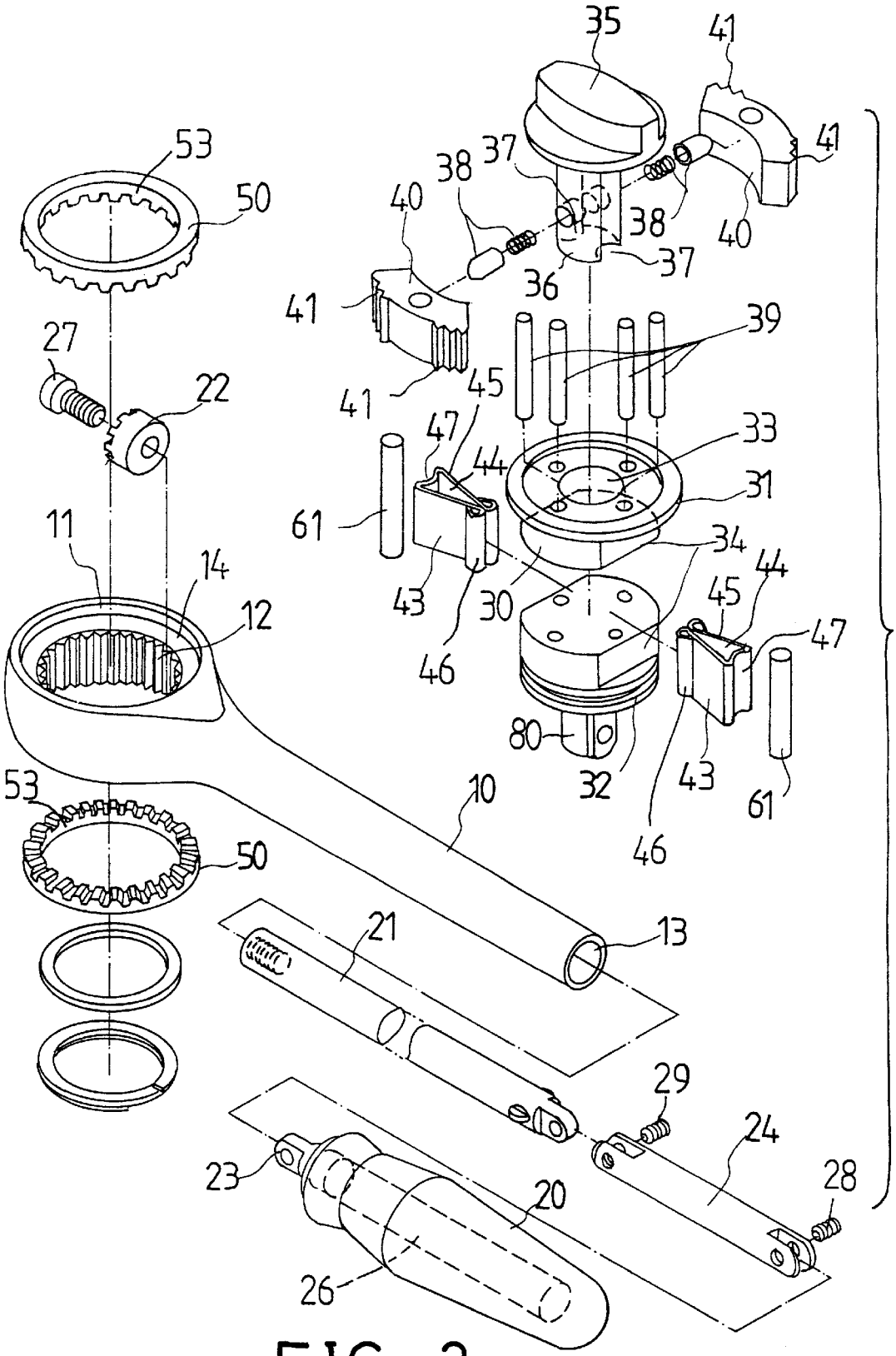
FIG. 3 is an exploded view of the ratchet wrench.
Figure 4:
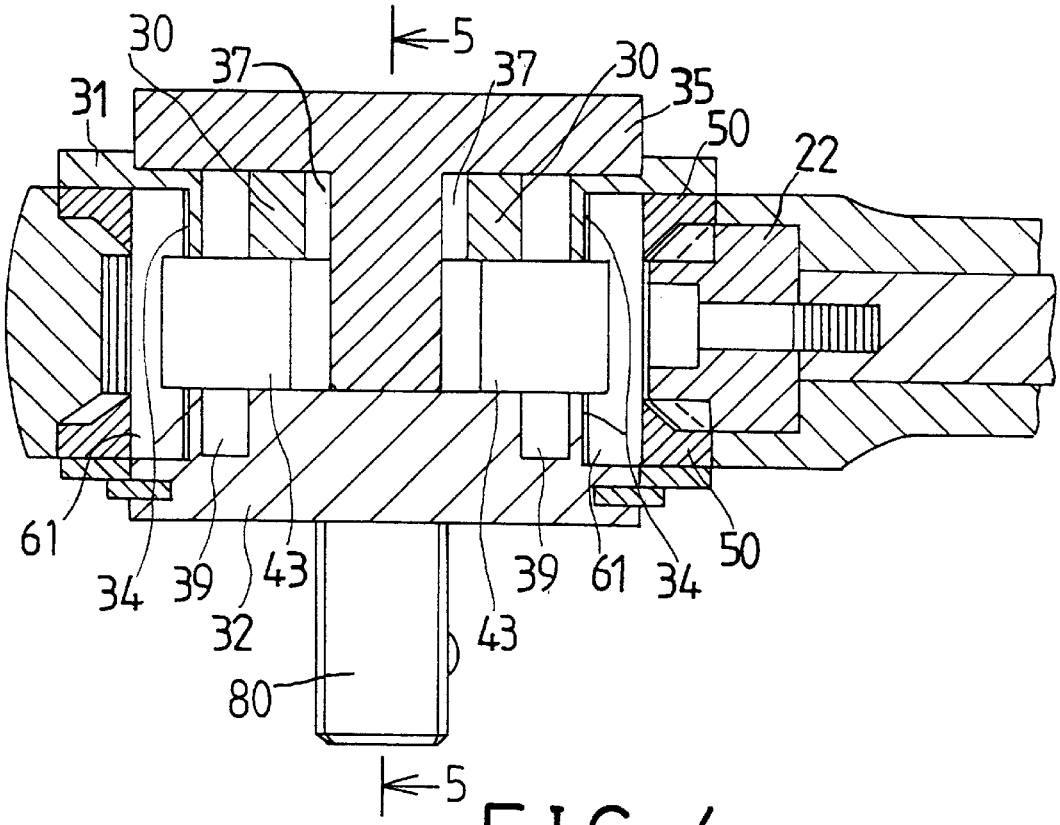
FIG. 4 is a cross sectional view taken along lines 4—4 of FIG. 1.
Figure 8:
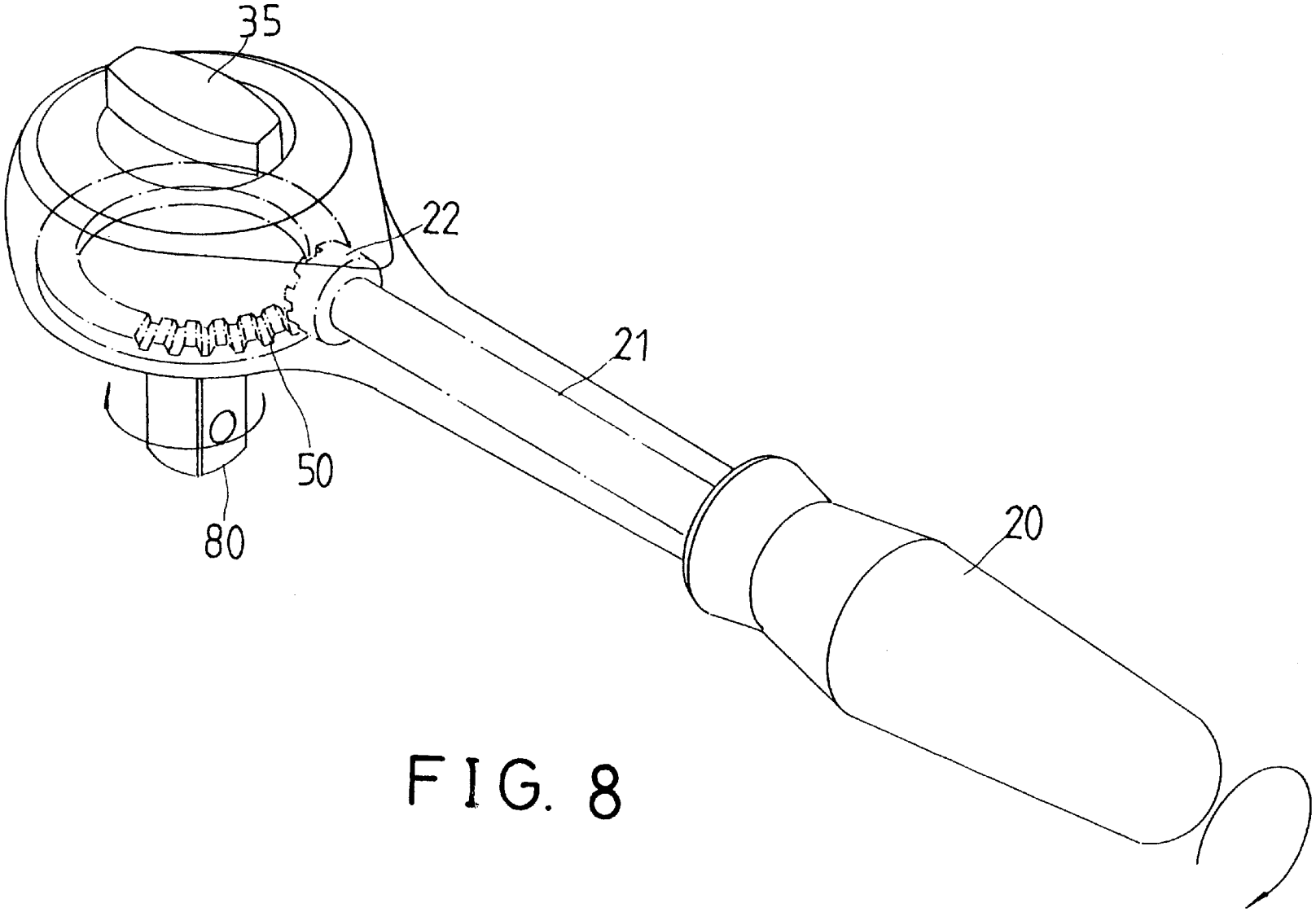
FIGS. 8, 9 and 10 are perspective views illustrating the operation of the ratchet wrench.
Figure 9:
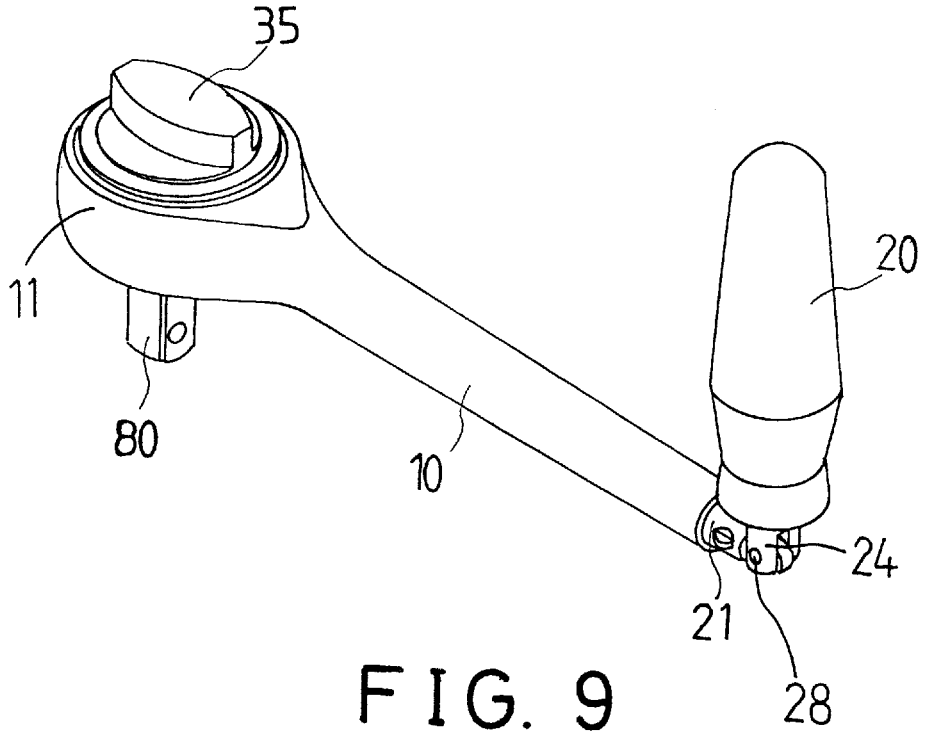
Figure 10:
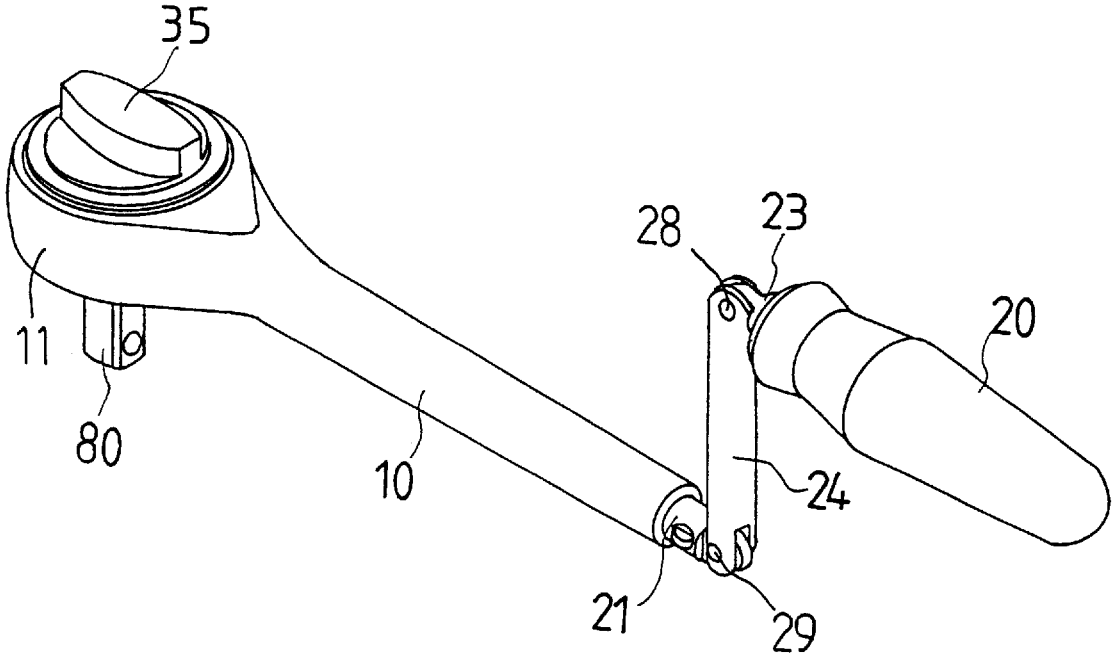

Referring to the drawings, and initially to FIGS. 1–5, a ratchet wrench in accordance with the present invention comprises a handle 10 including a head 11 formed or provided on one end thereof and including a bore 13 formed therein for rotatably receiving an axle 21 therein. The head 11 includes an internal gear 12 formed therein. A gear, such as a bevel gear 22 is secured to one end of the axle 21 with one or more fasteners 27 and located close to or engaged into the internal gear 12 of the head 11 (FIGS. 2, 4). A hand grip 20 includes a coupler 23 slidably received in an orifice 26 thereof, and a link 24 has two ends pivotally coupled to the coupler 23 and the axle 21 respectively with pivot pins 28, 29. The coupler 23 may be guided to slide in the orifice 26 of the hand grip 20 with a key engagement and may be rotated in concert with the hand grip 20 such that the coupler 23 may be rotated by the hand grip 20. The hand grip 20 is rotatable relative to the link 24 about the pin 28 (FIGS. 9, 10), but rotated in concert with the link 24 when the link 24 is in line with the hand grip 20. The link 24 is rotatable relative to the axle 21 about the pin 29 (FIG. 10), but rotated in concert with the axle 21 when the link 24 is in line with the axle 21. The link 24 and the coupler 23 may be received in the orifice 26 of the hand grip 20. The head 11 includes a pair of opposite peripheral shoulders 14 formed therein for rotatably receiving ring gears 50 respectively. The ring gears 50 are engaged with the bevel gear 22 (FIG. 8) such that the ring gears 50 may be rotated in different directions by the hand grip 20 via the link 24 and the axle 21.

Figure 6:
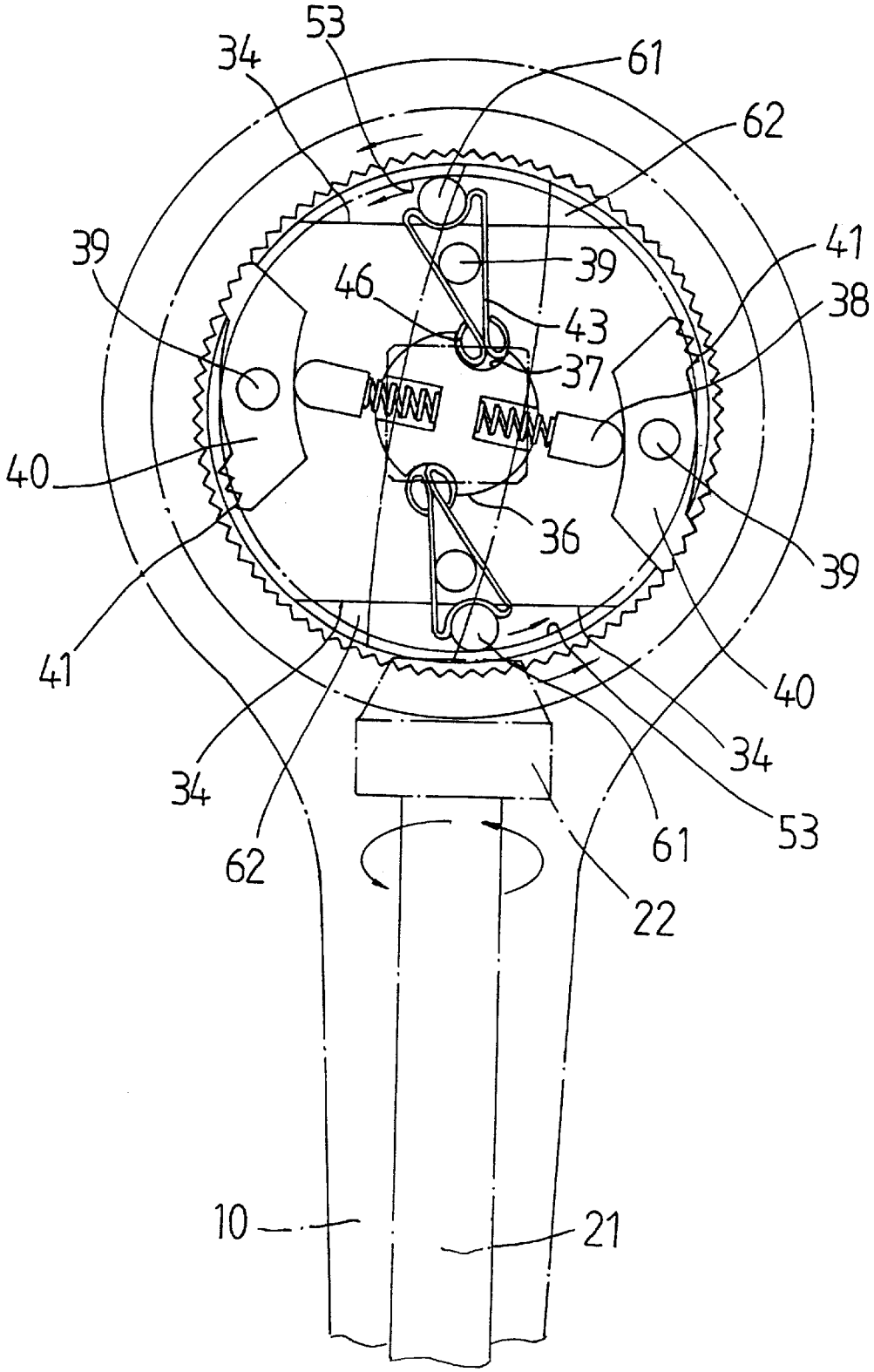
FIGS. 6 and 7 are plane schematic views illustrating the operation of the ratchet wrench.
Figure 7:
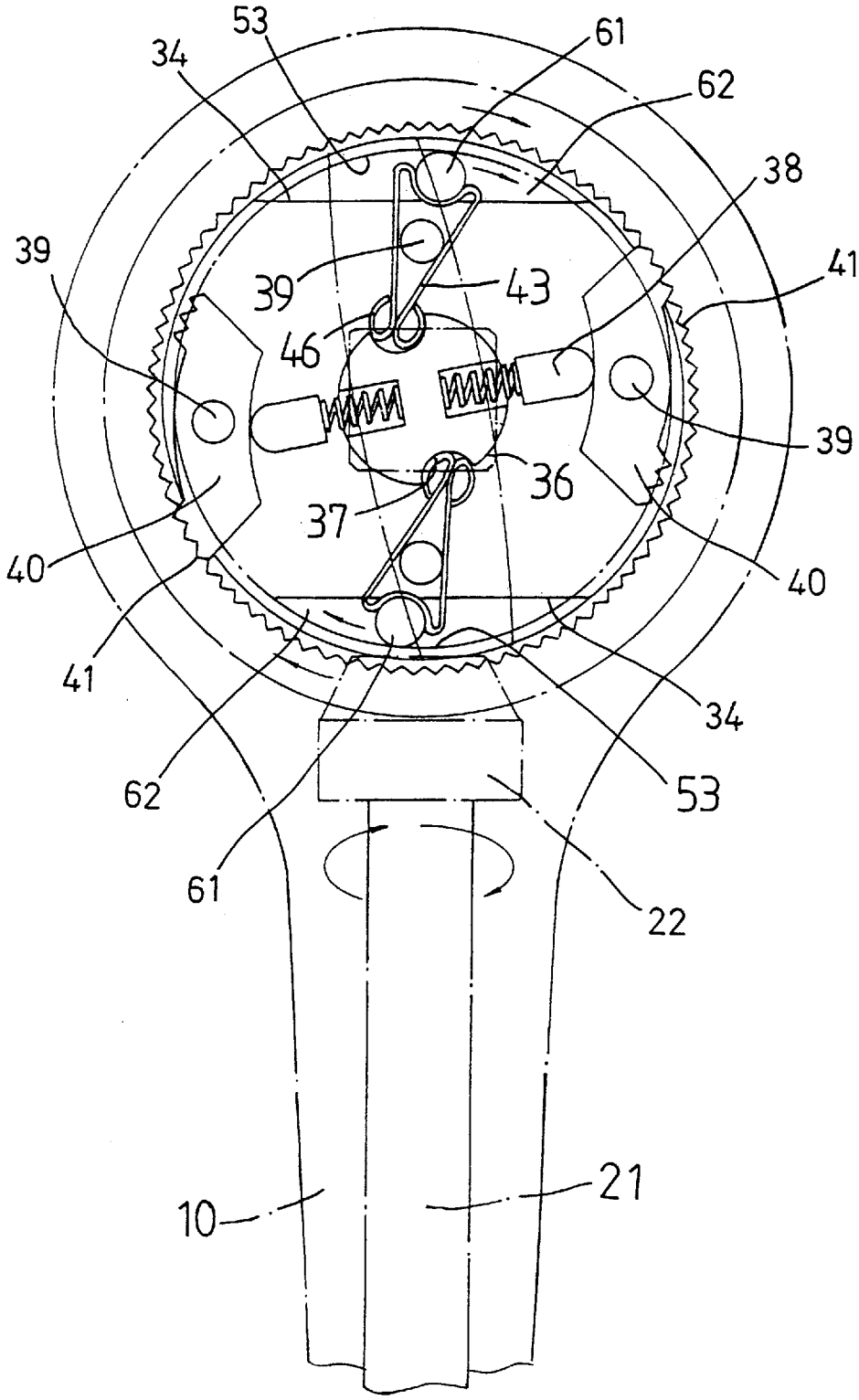

A block 30 and a seat 32 are rotatably received in the head 11 and each includes a pair of opposite flat surfaces 34 formed therein for defining channels 62 with the ring gears 50 (FIGS. 6, 7). The block 30 includes an aperture 33 formed therein and includes a peripheral flange 31 for engaging with the ring gear 50 and may be rotatably secured to the ring gear 50 or the head 11 with such as the retaining rings. The seat 32 may also be rotatably secured to the ring gear 50 or the head 11 with such as the retaining rings. The seat 32 includes a driving stem 80 extended therefrom for driving the fasteners. Four poles 39 are secured between the seat 32 and the block 30. A pair of pawls 40 are oppositely and rotatably secured between the seat 32 and the block 30 with two of the poles 39, and each includes two ends each having one or more teeth 41 for selectively engaging with the internal gear 12 (FIGS. 6, 7).

Figure 5:
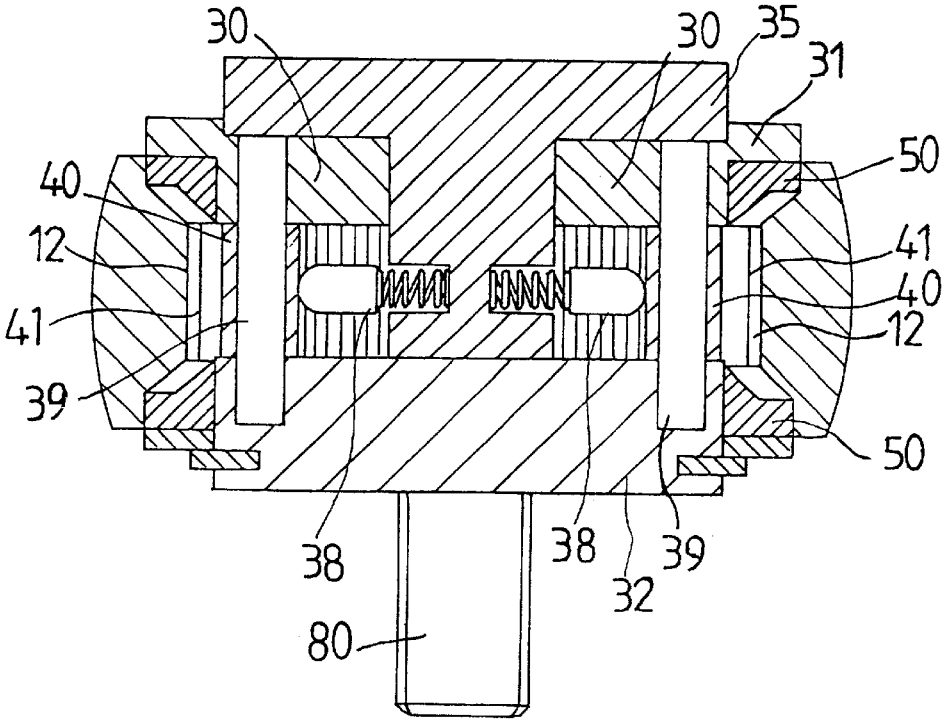
FIG. 5 is a cross sectional view taken along lines 5—5 of FIG. 4.

A knob 35 includes an extension 36 extended therefrom and rotatably received in the aperture 33 of the block 30. The extension 36 includes a pair of opposite recesses 37 formed therein and includes a pair of spring-biased projection 38 received therein and engaged with the pawls 40 for biasing the teeth 41 of the pawls 40 to engage with internal gear 12 (FIGS. 5–7). A pair of actuators 43 each includes a chamber 44 formed therein and defined by a pair of walls 45 for receiving the other two poles 39 and for rotatably securing the actuators 43 between the seat 32 and the block 30. The actuators 43 each includes a rounded end 46 rotatably received in the recesses 37 of the extension 36 and each includes a curved depression 47 formed in the other end for receiving a rod 61 respectively. The rods 61 are received in the channels 62 of the head 11 and selectively engaged in either of the reduced ends of the channels 62 and engaged with the inner peripheral surfaces 53 of the ring gears 50 (FIGS. 6, 7) for coupling, unidirectionally, the block 30 and the seat 32 to the head 11.

In operation, as shown in FIG. 6, when the teeth 41 on the ends of the pawls 40 are engaged with the internal gear 12 of the head 11, the block 30 and the seat 32 and thus the driving stem 80 may be driven counterclockwise by the handle 10 and may not be driven clockwise by the handle 10. At this moment, the rods 61 are engaged in one narrow ends of the channels 62 respectively and are engaged with the inner peripheral surfaces 53 of the ring gears 50. When the ring gears 50 are rotated in different directions by the hand grip 20 via the bevel gear 22, the rods 61 may be forced toward one of the narrower ends of the channels 62 and may be solidly engaged between one of the ring gears 50 (which rotates counterclockwise) and the block 30 and the seat 32 such that the block 30 and the seat 32 and thus the driving stem 80 may be driven counterclockwise by the one ring gear 50. The other ring gear 50 is rotated clockwise and thus will not be engaged with the rods 61 and may thus rotated freely relative to the rods 61. The engagement between the pawls 40 and the internal gear 12 allows the block 30 and the seat 32 to be rotated counterclockwise relative to the head 11 and may prevent the block 30 and the seat 32 from being rotated clockwise relative to the head 11. Accordingly, the block 30 and the seat 32 may either be driven counterclockwise by the head 11 and the handle 10 or by the hand grip 20 with one of the ring gears 50.

As shown in FIG. 7, when the teeth 41 on the other ends of the pawls 40 are engaged with the internal gear 12, the block 30 and the seat 32 and thus the driving stem 80 may be driven clockwise by the handle 10 and may not be driven counterclockwise by the handle 10. At this moment, the rods 61 are engaged in the other narrower ends of the channels 62 respectively and are engaged with the inner peripheral surfaces 53 of the ring gears 50, such that the rods 61 may be solidly engaged between one of the ring gears 50 (which rotates clockwise) and the block 30 and the seat 32 such that the block 30 and the seat 32 and thus the driving stem 80 may be driven clockwise by the one ring gear 50. The other ring gear 50 is rotated counterclockwise and thus will not be engaged with the rods 61 and may thus rotated freely relative to the rods 61. The engagement between the pawls 40 and the internal gear 12 allows the block 30 and the seat 32 to be rotated clockwise relative to the head 11 and may prevent the block 30 and the seat 32 from being rotated counterclockwise relative to the head 11. Accordingly, the block 30 and the seat 32 may either be driven clockwise by the head 11 and the handle 10 or by the hand grip 20 with one of the ring gears 50.

It is to be noted that the block 30 and the seat 32 may be solidly driven by the head 11 with the pawls 40 and will not be affected by the engagement between the ring gears 50 and the rods 61, such that the bevel gear 22 will not be subjected with any force or will not be twisted in this condition. Either of the ring gears 50 may be rotated counterclockwise and clockwise by the bevel gear 22, such that a single ring gear 50 is good enough to be driven counterclockwise and clockwise by the bevel gear 22 to drive the seat 32 and the driving stem 80. The block 30 and the seat 32 are solidly secured together with the poles 39 such that the block 30 and the seat 32 may be formed as a one-piece seat or member.

Accordingly, the ratchet wrench in accordance with the present invention includes an additional driving device for driving the driving stem.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle including a first end having a head formed thereon, said head including an internal gear formed therein, said handle including a bore formed therein and communicating with said internal gear;

at least one ring gear rotatably received in said head;

a bevel gear rotatably received in said bore of said handle and engaged with said at least one ring gear for rotating said at least one ring gear in either direction;

a seat rotatably received in said head and including a driving stem extended therefrom;

a pair of pawls rotatably secured to said seat and each including two ends for selectively engaging with said internal gear;

at least one rod engaged between said at least one ring gear and said seat to selectively drive said seat with said at least one ring gear; and means for rotating said bevel gear to rotate said at least one ring gear with said at least one rod.

2. The ratchet wrench according to claim 1. wherein said seat includes at least one surface formed thereon for defining a channel between said seat and said at least one ring gear and for defining two narrow ends for said channel.

3. The ratchet wrench according to claim 2 further comprising means for moving said at least one rod to either of said narrow ends of said channel.

4. The ratchet wrench according to claim 3, wherein said moving means includes at least one actuator rotatably secured on said seat and having a first end for receiving said at least one rod, and means for rotating said at least one actuator to move said at least one rod to either of said narrow ends of said channel.

5. The ratchet wrench according to claim 1 further comprising a block secured to said seat and including at least one surface formed thereon for defining a channel between said block and said at least one ring gear and for defining two narrow ends for said channel.

6. The ratchet wrench according to claim 5, wherein said block includes an aperture formed therein, a knob includes an extension rotatably received in said aperture of said block and includes means for selectively actuating said ends of said pawls to engage with said internal gear.

7. The ratchet wrench according to claim 6, wherein said actuating means includes a pair of spring-biased projections received in said extension of said knob and engaged with said pawls.

8. The ratchet wrench according to claim 6, wherein said seat includes at least one surface formed thereon for defining a channel between said seat and said at least one ring gear and for defining two narrow ends for said channel, said knob further includes means for moving said at least one rod to either of said narrow ends of said channel.

9. The ratchet wrench according to claim 8, wherein said moving means includes at least one actuator rotatably secured on said seat and having a first end for receiving said at least one rod, and means for rotating said at least one actuator to move said at least one rod to either of said narrow ends of said channel.

10. The ratchet wrench according to claim 9, wherein said at least one actuator rotating means includes at least one recess formed in said extension for rotatably receiving a second end of said at least one actuator.

* * * * *